United States Patent [19]

Lineberry et al.

[11] 4,173,911

[45] Nov. 13, 1979

[54] METHOD AND APPARATUS FOR HACKING AND STACKING BRICK

[76] Inventors: Cletus E. Lineberry, Rte. 1, Box 106, Staley, N.C. 27355; John G. Buckner, Rte. 2, Box 83, Ramseur, N.C. 27315; Jimmy W. Harris, 618 Circle Dr., Siler City, N.C. 27344

[21] Appl. No.: 910,647

[22] Filed: May 30, 1978

[51] Int. Cl.[2] ..... B26D 7/06; B28B 11/14

[52] U.S. Cl. ..... 83/29; 83/87; 83/90; 83/425.2; 83/651.1; 414/89

[58] Field of Search ..... 83/29, 87, 90, 425.2, 83/651.1, 91, 96; 214/6 A, 6 BA, 6 F

[56] References Cited

U.S. PATENT DOCUMENTS

| | | | |
|---|---|---|---|
| 2,917,991 | 12/1959 | Segur | 214/6 A X |
| 2,924,051 | 2/1960 | More | 214/6 BA X |
| 3,220,570 | 11/1965 | Swanson et al. | 214/6 BA |
| 3,478,896 | 11/1969 | Pearne | 214/6 A |
| 3,602,963 | 9/1971 | Lingl | 83/91 |

*Primary Examiner*—Frank T. Yost
*Attorney, Agent, or Firm*—Mills & Coats

[57] ABSTRACT

The present invention relates to a method and apparatus for hacking and stacking brick. Brick slugs are received on an off bearing belt and transferred to a discharge area. At the discharge area, a pusher on a fore stroke engages a slug on the off bearing belt and pushes the same onto a receiving area. While the slug is being pushed on the fore stroke, another slug arrives at the discharge area, and the pusher on the aft stroke engages this slug and pushes the same off the other side of the off bearing belt onto an elevator assembly aligned wth the off bearing belt which then moves up to a raised position aligned with a second receiving area. A second pusher driven in time relationship with the other pusher then moves the brick slug from the raised elevator assembly onto the second receiving area. The elevator assembly is then returned to its lower position and the steps referred to above is repeated such that during this operation the two pushers advance accumulated brick slugs across each receiving area and through a wire bank cutting brick assembly. After cutting, respective rows of cut brick then fall from a terminal edge of said second receiving area downwardly onto cut brick being advanced from and across said first receiving area to form a two course high stack of cut brick.

11 Claims, 7 Drawing Figures

METHOD AND APPARATUS FOR HACKING AND STACKING BRICK

The present invention relates to material handling, and more particularly to a method and apparatus for hacking and stacking brick.

BACKGROUND OF THE INVENTION

Typically in a brick producing operation, brick slugs are cut from an elongated extrusion, and transferred by an off bearing belt to an area where the brick slugs are cut to form individual bricks and the cut bricks are accumulated and then stacked onto a kiln car for drying and firing. In some instances, the extrusion is cut by a reel cutter while being transferred on the off bearing belt, and in other cases the extrusion is cut into slugs and the slugs are discharged from the off bearing belt and pushed through a wire bank cutter, An example of a conventional brick hacking and stacking operation is disclosed in U.S. Pat. No. 3,478,397.

One principal concern in designing brick hacking machinery is to provide a method and machine that has relatively high capacity. In the past, certain approaches have been undertaken to increase the capacity of brick hacking machines. For example, one approach has been to provide means for double stacking respective slugs on an off bearing belt prior to discharging the slugs from the off bearing belt through a wire bank cutting assembly. Another method is one such as that shown in our co-pending patent application, U.S. Patent Application Ser. No. 854,150, filed Nov. 23, 1977, now abandoned wherein brick slugs are discharged in single high course fashion from an off bearing belt and are directed through a wire bank cutter, after which the cut bricks are accumulated on a receiving table. An intermediate stacking elevator assembly is utilized to receive rows of cut brick from the receiving table and to stack the same brick in a two course high stack adjacent the stacking elevator opposite the receiving table. Bricks are allowed to accumulate to form a certain size two course high stack, after which a conventional head gripper assembly is utilized a grip the two course high stack and to transfer the same onto a kiln car.

While various approaches to increasing capacity of brick hacking machinery have been tried, many such approaches have involved complicated, expensive, and even sometimes unreliable machines. There still exists today the need for a high capacity, efficient, effective brick hacking machine and method that is simple and inexpensive, and which is adaptable to other conventional brick producing machinery used in the total brick producing operation.

SUMMARY OF THE INVENTION

The present invention entails a relatively high capacity method and apparatus for brick hacking that is relatively simple, inexpensive, and reliable. With respect to the present invention, brick slugs received on an off bearing belt are conveyed to a discharge area where a pusher moves fore-and-aftly transversely across the off bearing belt at the discharge area. Brick slugs are discharged from one side of the off bearing belt by the pusher during the fore stroke and the brick slug is received adjacent the off bearing belt on a first receiving area. In the meantime, a succeeding slug is transferred to the discharge area, and the pusher on an aft stroke engages the same and pushes this slug off the other side of the off bearing belt onto an elevator assembly which then moves to an upper discharge position aligned with a second receiving area vertically spaced from the first receiving area. Once in this position, a second pusher, driven in time relationship with the pusher disposed adjacent the off bearing belt, engages the brick slug on the elevator assembly and transfer the same onto said second receiving area. This is repeated such that the first and second pushers continually advance respective brick slugs across the respective receiving areas towards a wire bank cutter. As the brick slugs are advanced, respective slugs are forced through a wire bank cutter, where respective brick slugs are cut into individual bricks. As the cut bricks are forced through the wire bank cutter, the bricks about the uppermost receiving area fall onto the cut bricks being advanced along the first receiving area, so as to form a two course high brick stack.

Therefore, it is appreciated that in the brick hacking operation of the present invention, the first pusher, that is the pusher that discharges the respective slugs from the off bearing belt is effective during each stroke, both fore-and-aftly, to discharge slugs from the off bearing belt. Therefore, as in conventional practice in which the slugs are only pushed from one side of the off bearing belt, there is no retraction time wherein the pusher moves to a retracted position prior to its aft stroke in order to avoid interference with the succeeding brick slug being disposed in its path. Consequently, brick slugs are discharged from both sides of the off bearing belt in a wiping fashion, with the brick slugs discharged from one side being transferred vertically and across the off bearing belt through a bank cutter assembly onto cut brick that were cut from brick slugs discharged from the other side of said off bearing belt and advanced through the same bank cutter assembly.

It is, therefore, an object of the present invention to provide a method and apparatus for brick hacking that produces a relatively high output, but which is relatively inexpensive and simple in operation.

Another object of the present invention is to provide a method and apparatus for brick hacking wherein both fore-and-aft strokes of an off bearing belt pusher is utilized to discharge brick slugs from both sides of the off bearing belt, thereby doing away with the inefficiency inherent in retracting the pusher during the aft stroke to avoid interference with a succeeding brick slug on the off bearing belt lying in the path of the pusher.

Another object of the present invention is to provide in an efficient and effective method and apparatus of brick hacking wherein a two course high brick stack is formed for transfer by a head gripper assembly onto a kiln car.

Still a basic object of the present invention resides in the provision of a brick hacking apparatus and brick handling system that is capable of discharging brick slugs from each side of an off bearing belt to form two vertically spaced rows of brick slugs, and to advance each of the two formed rows in time relationship toward a wire bank cutting assembly and therethrough to where the cut brick about the uppermost row fall onto the cut row of the lowermost row to form a two course high stack of cut bricks.

Other objects and advantages of the present invention will become apparent from a study of the following description and the accompanying drawings which are merely illustrative of the present invention.

Figure 2:
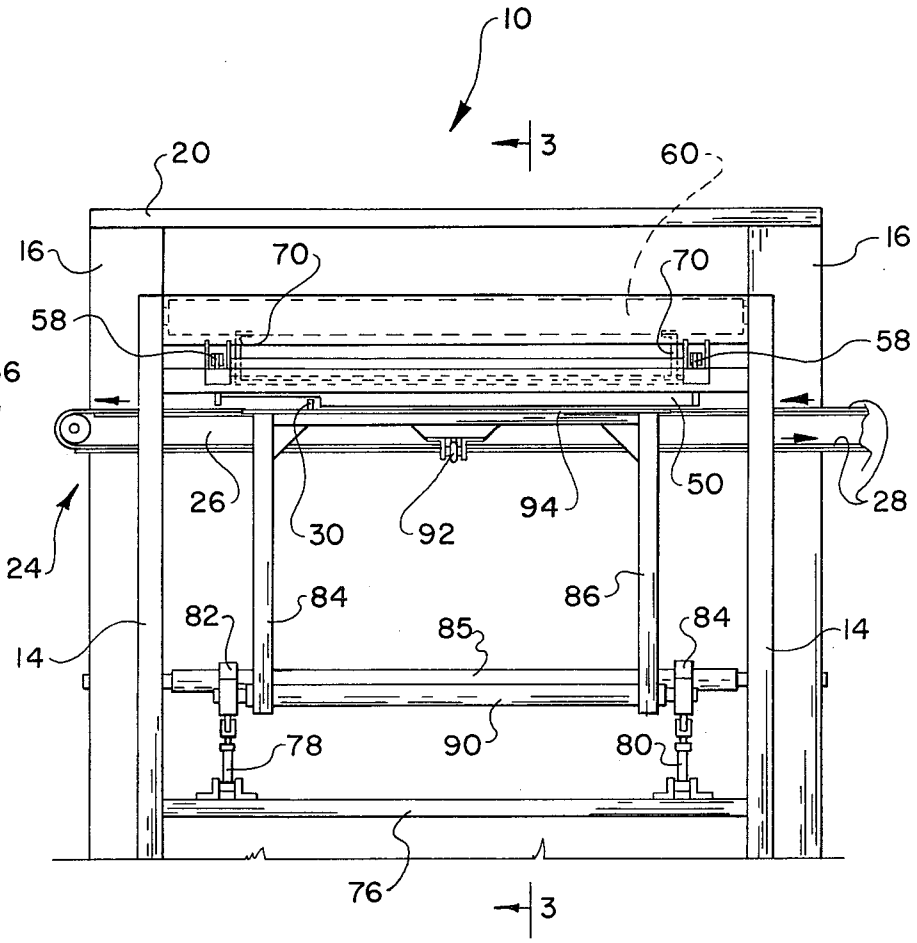
FIG. 2 is a transverse elevational view of the brick hacking and stacking apparatus taken along the lines 2—2 of FIG. 1.

With further reference to the drawings, the brick hacking and stacking apparatus of the present invention is shown therein and indicated generally by the numeral 10. Before proceeding with a detailed discussion of the brick hacking and stacking apparatus 10, it should be pointed out that the present invention relates to that part of a brick producing operation between the brick extrusion mills and where a gripper assembly is utilized to transfer a group or stack of brick from a spreader table onto a kiln car. Thus, in the present disclosure, the present invention relates to that part of the brick producing operation where brick slugs are received on an off bearing belt and conveyed to a discharge area where the brick slugs are discharged from the off bearing belt, and cut and stacked for transfer onto the kiln car.

With this in mind, and with particular reference to the drawings, the brick hacking and stacking apparatus 10 of the present invention includes an open upstanding main frame structure indicated generally by the numeral 12 comprised of a pair of rear legs 14 and a pair of front legs 16. Interconnected between respective front and rear legs are a pair of laterally spaced longitudinal side members 18. The main frame structure is given rigidity by the provision of a series of transverse members interconnected across the main frame structure and such transverse members include a front transverse member 20 interconnecting the forward legs 16 and a rear transverse member 22 interconnecting rear legs 14.

Figure 1:
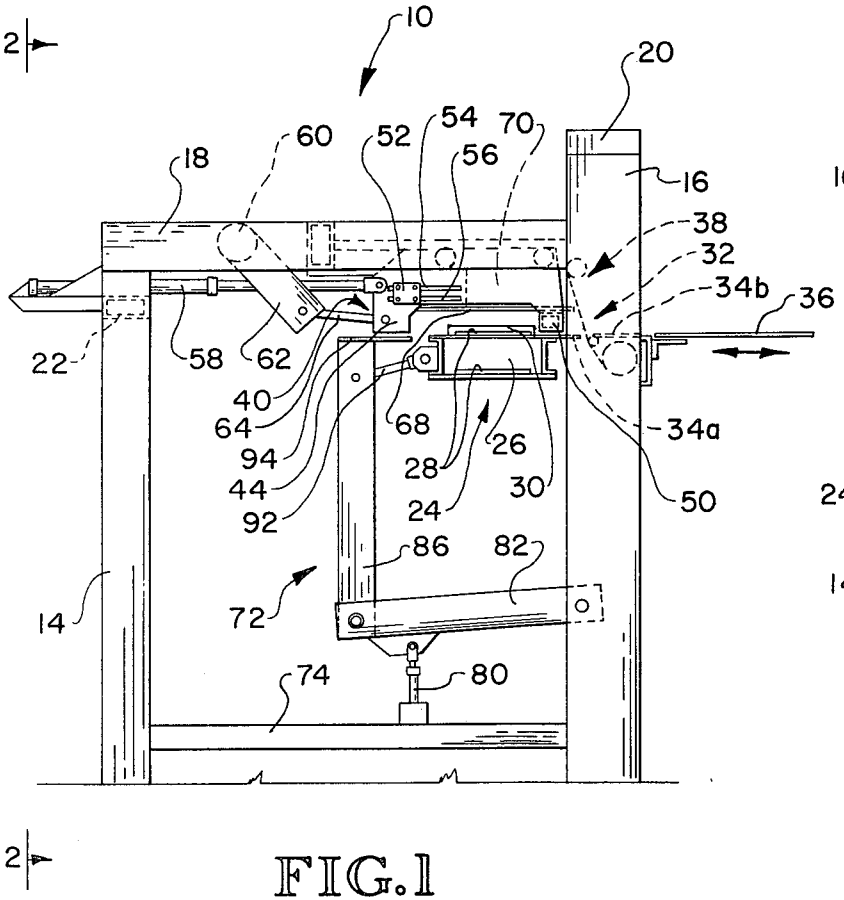
FIG. 1 is a side elevational view of the brick hacking and stacking apparatus of the present invention, particularly illustrating that portion of the apparatus that forms a two course high stack of cut brick.
Figure 3:
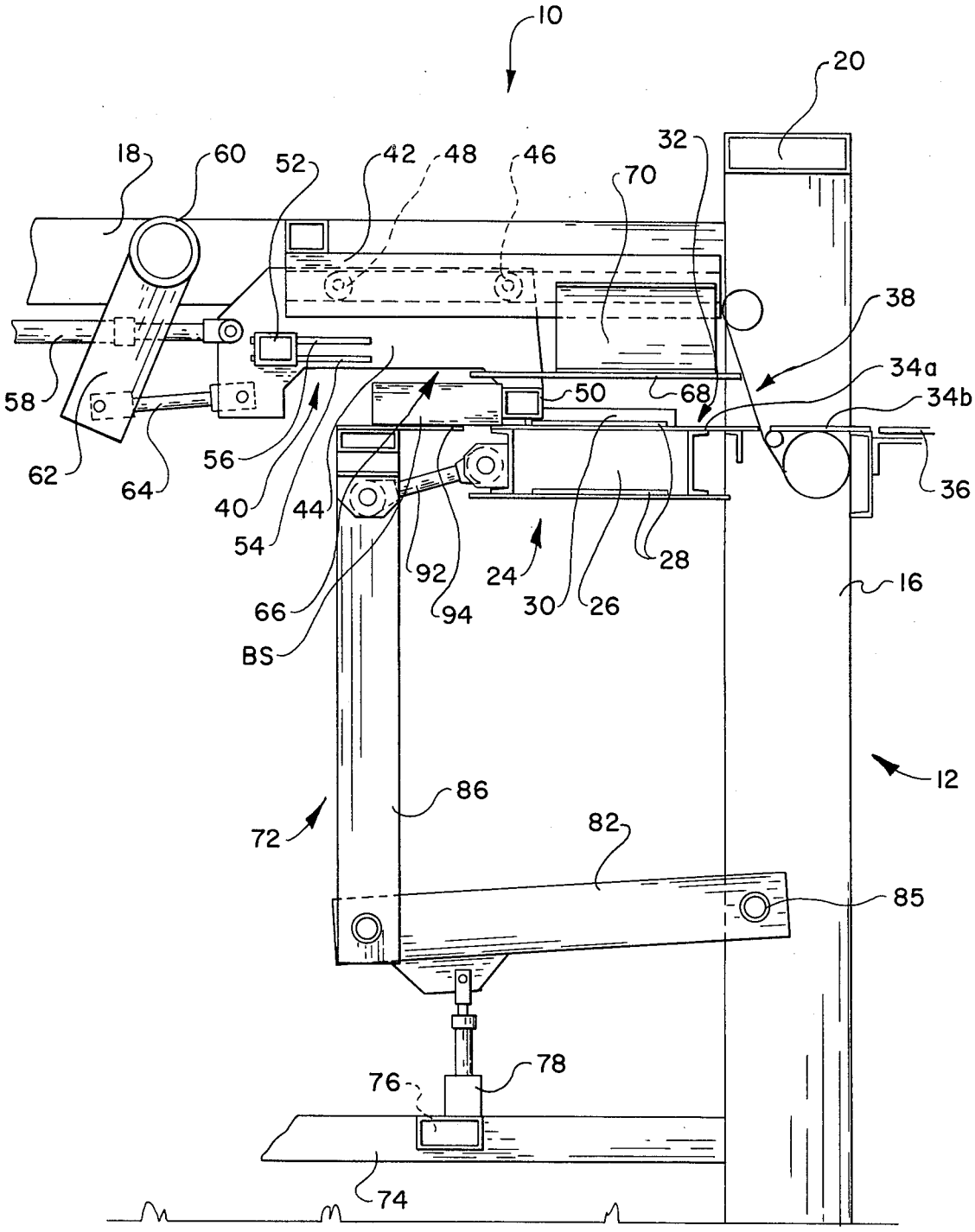
FIG. 3 is an enlarged sectional view of the brick hacking and stacking apparatus of the present invention taken along the lines 3—3 of FIG. 2.
Figure 4:
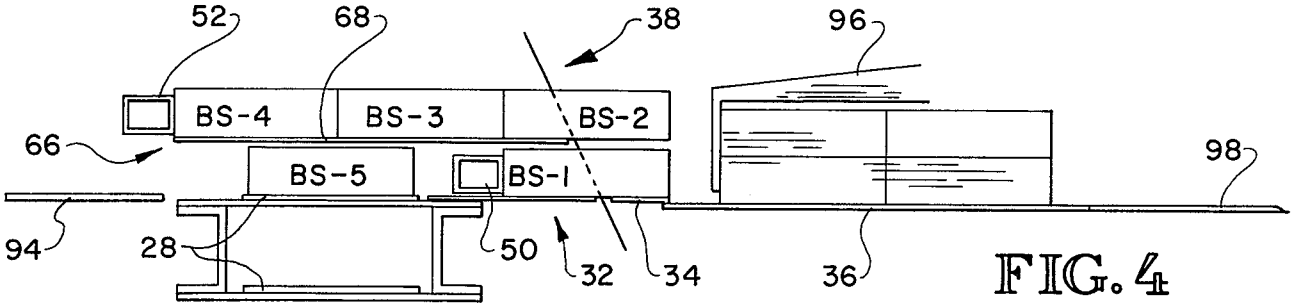
FIGS. 4 through 7 are a series of a sequence views illustrating the basic method and operation of the brick hacking and stacking apparatus of the present invention.
Figure 5:
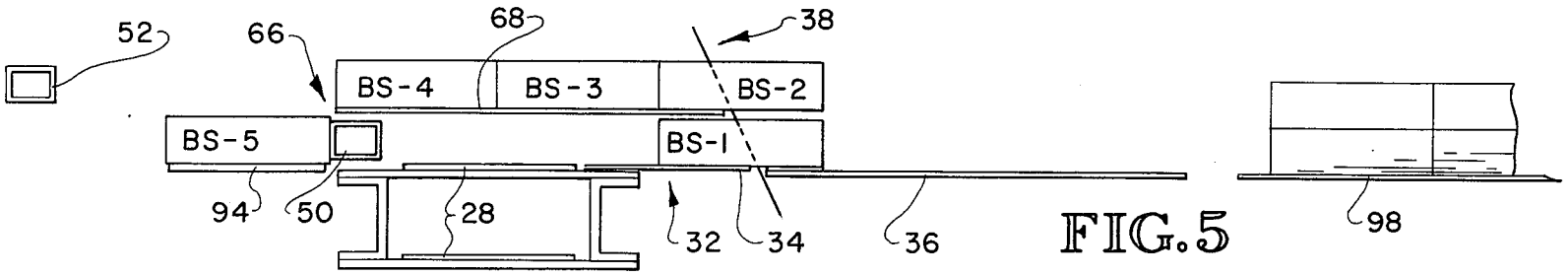
Figure 6:
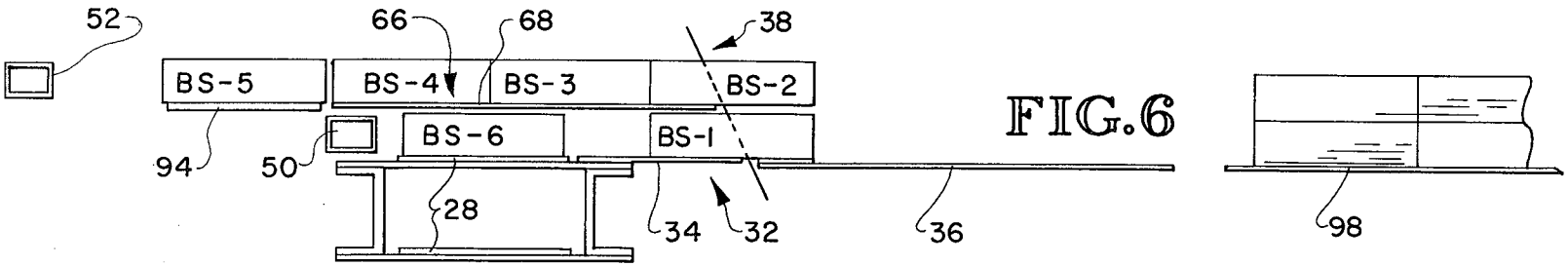
Figure 7:
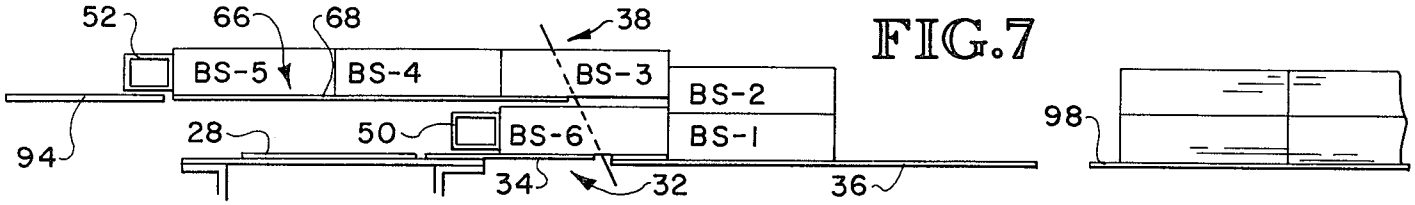

An off bearing belt assembly, indicated generally by the numeral 24, extends from one or more extrusion mills (not shown) to the brick hacking and stacking apparatus 10 and forms a part thereof. Off bearing assembly 24 includes a conveyor frame supported by the main frame structure 12 of the apparatus and includes an off bearing belt 28 secured and trained thereabout and driven so as to deliver respective brick slugs, BS, to a discharge area underneath frame structure 12, as illustrated in FIGS. 1, 2 and 3. Disposed about one end of the off bearing belt assembly 24 generally to one side and underneath main frame structure 12 is a slug stop 30 that is adapted to stop respective brick slugs conveyed by the off bearing belt assembly 24 at a discharge point within main frame structure 12. Although not shown, the slug stop 30 is effective to actuate a control switch that controls the fore-and-aft movement of the pusher carriage of the brick hacking and stacking apparatus, to be subsequently discussed herein.

On the right side of the off bearing belt assembly 24, as viewed in FIG. 1, there is shown a first receiving area indicated generally by the numeral 32. First receiving area 32 is adapted to receive slugs from the off bearing belt 28 and includes a first receiving plate area 34 having two divided plate areas 34*a* and 34*b* disposed directly adjacent the off bearing belt 28 and aligned therewith, and a second plate or table 36 that is disposed adjacent first plate area 34 and for purposes of brick separation second plate 36 is provided with means (not shown) for moving the same fore-and-aftly with respect to said first plate area 34.

Disposed between plates 34*a* and 34*b* and extending upwardly therefrom, is a conventional wire bank brick cutter assembly, indicated generally by the numeral 38, that is supported by the main frame structure 12 of the brick hacking and stacking apparatus 10, and which is adapted to cut at least two brick slugs disposed one over the other simultaneously as they are pushed therethrough. Details of the wire bank cutter assembly 38 are not dealt with herein in detail because such is well known in the art and is conventionally used today. It, however, may be stated that the wire bank cutting assembly includes a plurality of tensioned wires laterally spaced apart so as to cut respective slugs passed therethrough into a plurality of bricks.

Movably mounted in main frame structure 12 just above the off bearing belt assembly 24 is a pusher carriage assembly indicated generally by the numeral 40. Pusher carriage assembly 40 is movably mounted within a pair of carriage guide rails 42 secured inside of respective longitudinal members 18 of the main frame structure 12. Viewing pusher carriage assembly 40 in detail, it is seen that the same comprises a pair of laterally spaced carriage side plates 44, with each carriage side plate 44 including a pair of wheels 46 and 48 secured thereto and engaged within a respective guide rail 42. Carriage side plates 44 are secured together so as to move in unison by a first transverse pusher 50 formed and extending transversely across the lower front portion of the pusher carriage assembly 40. A second transverse pusher 52 also extends between the pair of carriage side plates 44 about an upper rearward portion thereof. In the case of the second pusher 52, there is provided means for adjusting the longitudinal position thereof with respect to the carriage assembly 40 and particularly first pusher 50. In this regard, there is provided a pair of slots 54 and 56 in each carriage side plate 44 that allows the second pusher 52 to be moved longitudinally back and forth therein with respect to the side plates and to be adjustably secured at a desired position therein.

To drive pusher carriage assembly 40, and pushers 50 and 52 associated therewith, there is provided a pair of hydraulic cylinders 58 that are anchored to rear transverse member 22 and wherein the rod ends thereof extends forwardly to where they are connected to pusher carriage assembly 40. Hydraulic cylinders 58 are actuated in unison by switch means (not shown) operatively responsive to the engagement of a brick slug BS with the brick stop 30 disposed about the off bearing belt assembly 24.

To stabilize the pusher carriage assembly 40 in its fore-and-aft movement cycle, a torsion bar assembly is operatively connected to the respective carriage side plate assembly 44. In this regard, a torsion shaft 60 is rotatably journaled transversely between longitudinal side members 18 of the main frame structure 12, and includes a pair of connecting arms 62 secured about opposite end portions of torsion shaft 60 and which extend therefrom where the lower terminal ends are connected to respective interconnecting links 64 which extend to and connect to respective carriage side plates 44. Consequently, as the pusher carriage assembly 40 moves fore-and-aftly within main frame structure 12, it is appreciated that the torsion bar assembly and particularly the interconnecting links 64 and arms 62 connected therebetween maintain the pusher carriage in a stable posture.

Aligned with second pusher 52 and disposed generally above off bearing belt 24 and plates 34*a* and 34*b* of the first receiving area 32, there is provided a second receiving area indicated generally by the numeral 66. Second receiving area 66 comprises a generally flat horizontally aligned plate 68 that extends across the main frame structure 12 and is supported thereabout by a pair of attaching members 70 secured to the main frame structure 12 and depending therefrom. It is thusly appreciated that second receiving area 66 and plate structure 68 is adapted to receive brick slugs BS.

Disposed about one side of the off bearing belt conveyor assembly 24, opposite the first receiving area 32, is an elevator assembly, indicated generally by the numeral 72. As will be understood from the subsequent discussion, the function of the elevator assembly 72 is to receive every other brick slug or every other group of brick slugs from the off bearing belt 28 and to elevate and transfer the received brick slug or brick slugs to a position where the second pusher 52 may be employed to push and transfer the respective brick slugs from the elevator assembly 72 onto the second receiving area or plate 68.

Viewing elevator assembly 72 in more detail, it is seen that the same is supported by a pair of longitudinal base members 74 that extend between legs 14 and 16 of main frame structure 12. Interconnected between longitudinal members 74 is a transverse member 76 which has two hydraulic cylinders 78 and 80 anchored thereto. The rod end of hydraulic cylinder 78 and 80 are connected to a pair of lift arms 82 and 84 that are secured about a transverse shaft 85 that extends between legs 16. Another transverse shaft 90 extends between respective end portions of arms 82 and 84, and connected to shaft 90 in spaced apart relationship is a pair of vertical support posts 84 and 86. Secured across the top portion of support posts 84 and 86 is a receiving plate 94 that is adapted to receive brick slugs transferred from the off bearing belt 28 thereto. In order to guide elevator assembly 72 and particularly receiving plate 94 thereof, there is provided a guide link 92 that is pivotably connected to conveyor frame 26 and extends therefrom where the other end is pivotably connected to the structure of the elevator assembly 72 just underneath the receiving plate 94 thereof.

During the brick hacking and stacking operation, hydraulic cylinders 78 and 80 are actuated to move the elevator assembly 72 between a first receiving position where the receiving plate 94 aligns with off bearing belt 28 to a discharge position where the same receiving plate aligns with the second receiving area 66 and plate 68 thereof. Consequently, it is appreciated then that respective brick slugs BS can be transferred from the off bearing belt 28 to the second receiving area 66. A more complete discussion of the basic transfer operation will be dealt with subsequently herein.

As illustrated in FIGS. 4 through 7, the brick hacking and stacking apparatus of the present invention is shown to include a conventional puller 96 which is adapted upon actuation to engage a group or stack of accumulated brick formed on table 36 and to pull the same onto a spreader table 98.

With reference to FIGS. 4 through 7, the basic brick hacking and stacking method and apparatus of the present invention is illustrated therein. A starting point for discussion will be FIG. 4 wherein there is shown a brick slug BS-1 on receiving table 34, and brick slugs BS-2, BS-3, and BS-4 disposed about the second receiving area 66. In this position, table 36 has been moved to an extended position to the right of the wire bank cutting assembly 38 and puller 96 is shown engaging the two course high stack of brick thereon in order to pull the same onto a spreader table 98. Also at this point in the operation, the pusher carriage assembly 40 is fully extended and the respective pushers 50 and 52 are at the extreme end of their fore stroke. The receiving plate 94 of the elevator assembly 72 is in its receiving position and aligned with off bearing belt 28. A slug BS-5 is received on the off bearing belt 28 and has been conveyed to the end thereof to the discharge area where the same engages slug stop 30 and the slug is held thereat and lies in the path of pusher 50.

Slug stop 30 then actuates hydraulic cylinders 58 which causes the pusher carriage assembly 40 to begin to move right to left (as viewed in FIGS. 4–7), and this results in pusher 50 engaging slug BS-5 and causing the same to be transferred onto the receiving plate 94 of the elevator assembly 72. At this point second pusher 52 lies to the left of receiving table 94 and through position actuating means (not shown) the hydraulic cylinders 78 and 80 are caused to be actuated so as to cause the elevator assembly 72 to move upwardly to where the same is in a discharge position and the receiving plate 94 thereof aligns with the plate 68 at the second receiving area 66. In the meantime, another brick slug BS-6 has been received in the discharge area and is being held in the path of the first pusher 50 by the slug stop 30. At this point the slug stop 30 then actuates the pusher carriage assembly 40 causing the same to moved right to left. This right to left movement of the pusher carriage assembly 40 results in pusher 50 engaging brick slug BS-6 and causing the same to be transferred onto plate 34 of the first receiving area 32. During the same right to left movement, second pusher 52 engages slug BS-5 and transfers the same onto the second receiving area 66. The simultaneous movement of pushers 50 and 52 causes slugs BS-1 and BS-2, that were initially pushed intermediately through the wire cutting bank 38, to be completely pushed therethrough. It is appreciated that plate 68 of the second receiving area 66 terminate at the edge of the wire bank cutting assembly 38 and this allows the brick slugs being advanced across this area through the wire bank cutting assembly 38 to fall onto the cut brick being advanced along the first receiving area 32 and through the wire bank cutting assembly 38.

The basic operation illustrated in FIGS. 4 through 7 is repeated until a desired stack of brick are received on receiving table 36 at which point the receiving table 36 is actuated to the right, as viewed through FIGS. 4 through 7, so as to separate the leftmost edge of brick of the stack from the brick being supported on tables 34 and 68. Once this separation is achieved, the puller 96 is actuated which engages the stack of brick and pulls the same onto the spreading table 98, and when a desired group or stack of brick have accumulated thereon, a conventional gripper assembly is actuated so as to transfer the accumulated brick on the spreader table to a kiln car.

Therefore, from the above specification, it is appreciated that the method and apparatus of the present invention provides for a brick hacking operation that is extremely efficient and effective. The capacity of the apparatus is greatly and substantially increased by the double transfer action of the lower first pusher 50 which is effective to discharge brick slugs from the off bearing belt 28 on both the fore-and-aft strokes. With the provision of the elevator assembly that is driven in time relationship to the pusher carriage assembly 40, the brick hacking and stacking apparatus 10 of the present invention is able to advance two lines or rows of brick simultaneously in a time relationship towards and through a wire bank cutting assembly 40 where brick slugs are cut into individual bricks and wherein the apparatus is so designed that the cut brick about the upper level fall onto the cut brick of the lower level to form a stack of bricks two courses high. It is appreciated that more than one brick slug at a time can be transferred from the off bearing belt by appropriately designing the apparatus and controls to handle such.

The terms "upper", "lower", "forward", "rearward", etc., have been used herein merely for the convenience of the foregoing specification and in the appended claims to describe the method and apparatus for hacking and stacking brick and its parts as oriented in the drawings. It is to be understood, however, that these terms are in no way limiting to the invention since the method and apparatus for hacking and stacking brick may obviously be disposed in many different positions when in actual use.

The present invention, of course, may be carried out it other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. In a brick stacking apparatus of the type having an off bearing belt for receiving brick slugs or brick material units and conveying the same to a discharge area, and pusher means for engaging respective brick slugs at said discharge area and pushing them off one side of said off bearing belt onto an adjacent first receiving area, the improvement comprising: a second receiving area vertically spaced relative to said off bearing belt; and means for engaging certain brick slugs on said off bearing belt at said discharge area and pushing them off the other side thereof opposite said one side and transferring said brick slugs onto said second receiving area and pushing said brick slugs across said second receiving area in time relationship to the movement of said pusher means and the brick slugs being pushed off said one side onto said first receiving area, in order that the brick slugs or units from the receiving area disposed uppermost fall onto the brick slugs or units of the receiving area disposed lowermost to form an at least two course high brick stack.

2. The brick stacking apparatus of claim 1 wherein said means for pushing respective brick slugs or units off said other side of said off bearing belt and transferring the same onto said second receiving area includes a vertically movable elevator assembly movable between a first position aligned with said off bearing belt and a second position aligned with said second receiving area; and wherein said pusher means is provided with a drive means for driving the same fore-and-aftly across said off bearing belt and wherein said pusher means is adapted to engage brick slugs or units on its aft stroke and push the same off said off bearing belt onto said elevator assembly where the same brick slugs can be transferred to said second position; and wherein second pusher means align with said brick slugs or units disposed on said second receiving area and is provided for pushing said brick slugs thereacross in time relationship with brick slugs or units being pushed by said pusher means toward said first receiving area.

3. A brick stacking apparatus for stacking brick in at least a two course high stack comprising:

a. an off bearing belt adapted to receive brick slugs and to convey successive brick slugs received thereon to a discharge area;

b. a first receiving area disposed adjacent one side of said off bearing belt in the vicinity of said discharge area;

c. a second receiving area vertically spaced relative to said off bearing belt and said first receiving area in the vicinity of said discharge area;

d. an elevator assembly disposed on the other side of said off bearing belt opposite said first receiving area and movable between a first position generally aligned with said off bearing belt and a second position aligned with said second receiving area;

e. first pusher means disposed above and adjacent said off bearing belt and movable fore-and-aftly across said off bearing belt so as to engage and move a respective brick slug from said off bearing belt onto said first receiving area on the fore stroke and to engage and move the next successive brick slug on the off bearing belt from said off bearing belt onto said elevator assembly on the aft stroke;

f. second pusher means vertically spaced from said first pusher means and aligned for transferring respective brick slugs from said elevator assembly in said second position onto said second receiving area;

g. drive means for driving said first and second pusher means in time relationship such that brick slugs on said first and second receiving areas are advanced in the same direction generally equally and in time sequence; and h. drive means for cycling said elevator assembly between said first and second positions in time relationship to the fore-and-aft movement of said first and second pusher means such that during the aft movement of said first pusher means said elevator assembly is aligned with said off bearing belt, and during the fore stroke of said second pusher means said elevator assembly is aligned with said second receiving area, whereby during the brick stacking operation two rows of brick slugs are advanced one over the other along said first and second receiving areas by said first and second pusher means and wherein bricks being advanced about the uppermost receiving area fall onto bricks being advanced along the lowermost receiving area to form an at least two course high stack of brick.

4. The brick stacking apparatus of claim 3 wherein said second receiving area is positioned directly above said off bearing belt and said first receiving area, and wherein said second receiving area is positioned a distance slightly greater than the height of a single brick slug above said first receiving area.

5. The brick stacking apparatus of claim 4 further including cutting means disposed in the path of said advancing brick slugs on said first and second receiving areas for cutting the respective brick slugs into a transverse row of cut bricks as the respective brick slugs are advanced through said cutting means.

6. The brick stacking apparatus of claim 5 wherein said first and second receiving areas have terminal edges and said brick slugs received thereon are progressively advanced towards said terminal edges during the brick stacking operation, and wherein said cutting means is disposed transversely adjacent said terminal edges such that respective brick slugs being advanced pass said terminal edges are cut by said cutting means and wherein the cut brick exiting said second receiving area fall onto the cut brick of said first receiving area as the cut brick slugs pass from their respective receiving areas through said cutting means, so as to form an at least two course high stack of cut brick.

7. The brick stacking apparatus of claim 6 wherein said brick stacking apparatus comprises a main frame structure including a pusher carriage movably mounted in said main frame structure for fore-and-aft movement therein, and wherein said first pusher means is disposed about a lower forward portion of said pusher carriage, and wherein said second pusher means is disposed about an upper rearward portion of said pusher carriage.

8. The brick stacking apparatus of claim 3 wherein said brick stacking apparatus includes a main frame structure wherein said first and second pusher means form a part of a pusher carriage assembly mounted for fore-and-aft longitudinal movement within said main frame structure; and wherein said pusher carriage assembly includes two laterally spaced carriage side plates having said first and second pusher means secured therebetween and extending across between said two side plates with said second pusher means being aligned with said second receiving area and said first pusher means being disposed generally below and forwardly of said second pusher means and aligned with said first receiving area wherein said first pusher means is operative to transfer brick slugs from said off bearing belt to said first receiving area during the fore stroke and to transfer brick slugs from the same off bearing belt onto said elevator assembly on the aft stroke.

9. The brick stacking apparatus of claim 8 wherein said elevator assembly comprises a pair of laterally spaced arms pivotably mounted about a transfer axis extending transversely relative to said main frame structure, and wherein said arms are driven and rotated about said transverse axis by said elevator assembly drive means; a pair of support posts operatively driven by said arms and extending generally upwardly therefrom; a horizontally oriented receiving plate supported by said support post and extending transversely thereacross for receiving brick slugs thereon and transferring such from said first position to said second position; and guide link means operatively connected to said elevator assembly for generally guiding the same about a predetermined path as the same is cycled between said first and second positions.

10. A method of receiving and cutting brick slugs and stacking the cut brick slugs in a two course high stack, comprising the steps of:

a. receiving successive brick slugs on an off bearing belt and conveying the received brick slugs to a discharge area such that one or more brick slugs after another are received at said discharge area;
b. pushing one brick slug from one side of said off bearing belt onto a first receiving area;
c. pushing a succeeding brick slug from the other side of said off bearing belt and transferring the same to an elevator;
d. moving the elevator from a receiving position to a discharge position where the same aligns with a second receiving area;
e. transferring the brick slug on said elevator at said discharge position to said second receiving area;
f. returning said elevator to said receiving position;
g. continuing to transfer brick slugs in alternate fashion from said off bearing belt to said first receiving area and said elevator, and continuing to cycle said elevator between said receiving and discharge positions such that brick slugs may be transferred from said elevator to said second receiving area; and
h. cutting the respective brick slugs being advanced on said first and second receiving areas and directing the cut brick being advanced across the uppermost receiving area onto the cut brick being advanced across the lowermost receiving area to form a stack of brick at least two courses high.

11. The method of claim 10 wherein the brick slugs are cut prior to the brick material on the uppermost receiving area being directed onto the brick material being advanced across the first receiving area.

* * * * *